US010541063B2

(12) United States Patent
Tang

(10) Patent No.: US 10,541,063 B2
(45) Date of Patent: Jan. 21, 2020

(54) POWER INDUCTOR

(71) Applicant: Bel Fuse (MACAO COMMERCIAL OFFSHORE) Limited, Andar H-K (MO)

(72) Inventor: Zhao Tang, Zhejiang (CN)

(73) Assignee: Bel Fuse (Macao Commercial Offshore) Limited, Macau (CN)

( * ) Notice: Subject to any disclaimer, the term of this patent is extended or adjusted under 35 U.S.C. 154(b) by 385 days.

(21) Appl. No.: 15/233,446

(22) Filed: Aug. 10, 2016

(65) Prior Publication Data

US 2017/0047157 A1 Feb. 16, 2017

Related U.S. Application Data

(60) Provisional application No. 62/203,545, filed on Aug. 11, 2015.

(51) Int. Cl.
*H01F 27/29* (2006.01)
*H01B 1/02* (2006.01)

(52) U.S. Cl.
CPC ..... *H01B 1/026* (2013.01)

(58) Field of Classification Search
CPC ..... H01F 2027/297
USPC ..... 336/192
See application file for complete search history.

(56) References Cited

U.S. PATENT DOCUMENTS

2008/0074225 A1 3/2008 Hansen et al.
2011/0205008 A1* 8/2011 Brennan ..... H01F 27/2847 336/221
2014/0292458 A1 10/2014 Andres et al.
2014/0292459 A1 10/2014 Andres et al.
2015/0332844 A1* 11/2015 Xiong ..... H02H 7/1213 323/271

FOREIGN PATENT DOCUMENTS

| | | |
|---|---|---|
| CN | 1719262 | 1/2006 |
| CN | 201570364 | 9/2010 |
| CN | 102640233 | 8/2012 |
| CN | 102792584 | 11/2012 |
| CN | 104078194 | 10/2014 |
| CN | 104204820 | 12/2014 |
| CN | 104767405 | 7/2015 |

* cited by examiner

*Primary Examiner* — Ronald Hinson
(74) *Attorney, Agent, or Firm* — BainwoodHuang

(57) ABSTRACT

A power inductor includes a core and winding. The winding has at least two portions, one made of pure copper and the other made of a low-TCR (temperature coefficient of resistance) alloy, wherein the alloy portion is used to form a current sensor. The two portions are joined to provide a unitary winding. The inductor can provide accurate current detection sensor while minimizing total resistance of the winding.

10 Claims, 3 Drawing Sheets

POWER INDUCTOR

BACKGROUND

The invention is related to the field of power inductors such as used in power supplies and other high-current applications.

A power inductor consists of a core and a winding. Because the winding needs good conductive properties, usually pure copper is chosen as the material of winding.

SUMMARY

In practical applications, it may be necessary to detect the current flowing through a power inductor to realize current monitoring and/or system protection. But, because the temperature coefficient of resistance (TCR) of pure copper is high, the equivalent DC resistance (DCR) of a winding made of pure copper varies much as the temperature varies, so it can be difficult to accurately detect the current flowing through the inductor over a normal range of operating temperature.

Chinese patent 200410062281.X gives a method using low TCR materials of nickel-copper alloy or manganese-copper alloy as the winding material. This method overcomes the drawback of winding made of pure copper, and can obtain more accurate DCR of the winding. However, the resistivity of low-TCR materials such as nickel-copper alloy or manganese-copper alloy is much higher than pure copper. To get a certain equivalent resistance DCR, the cross-section of winding made of low TCR materials such as nickel-copper alloy or manganese-copper alloy will be much larger than a winding made of pure copper. For a limited size inductor, it may be necessary to increase the windows of the core, and reduce the effective cross-section (Ae) of the core, increasing power loss of the inductor.

A power inductor is disclosed that includes a core and winding. The winding has at least two portions, one made of pure copper and the other made of a low-TCR (temperature coefficient of resistance) alloy, wherein the alloy portion is used to form a current sensor. The two portions are joined to provide a unitary winding. The inductor can provide accurate current detection sensor while minimizing total resistance of the winding.

BRIEF DESCRIPTION OF THE DRAWINGS

The foregoing and other objects, features and advantages will be apparent from the following description of particular embodiments of the invention, as illustrated in the accompanying drawings.

DETAILED DESCRIPTION

Figure 9:
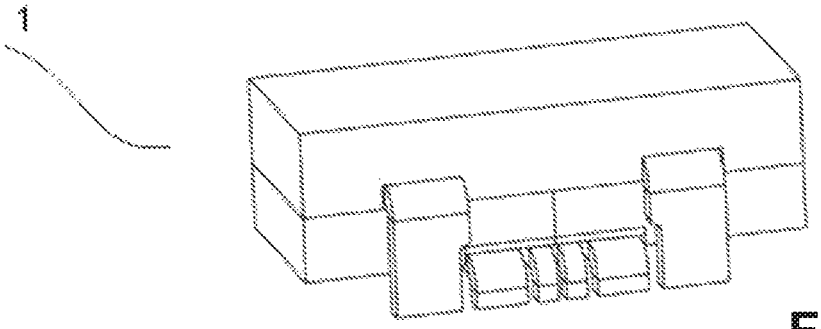
FIG. 9 is a perspective view of an inductor.
Figure 10:
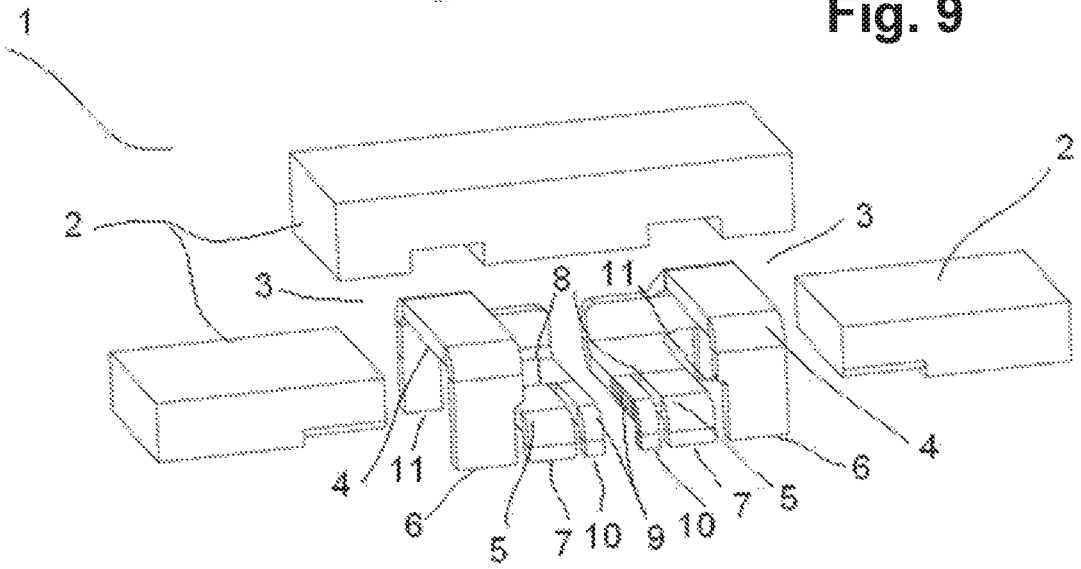
FIG. 10 is a exploded perspective view of the inductor of FIG. 9.
Figure 11:
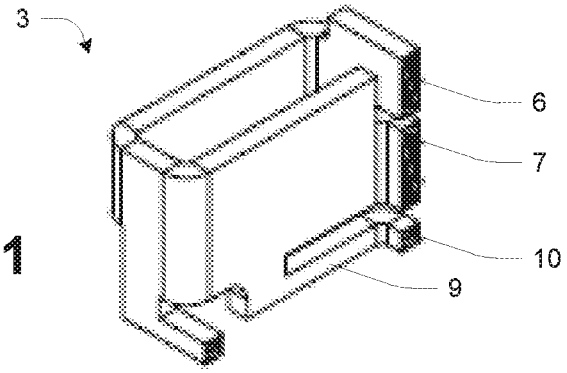
FIG. 11 is a perspective view of an inductor winding.

FIGS. 1-11 show several example embodiments. FIGS. 1-10 show five distinct inductors as assembled and exploded, while FIG. 11 shows just a winding for an inductor, omitting the core. The same reference numbers are used to refer to either the same or analogous parts throughout, even though the embodiments have generally different configurations. For example, each embodiment includes a respective winding identified with reference number 3 in all views, even though the specific configuration of the winding 3 is different in the various embodiments.

Figure 1:
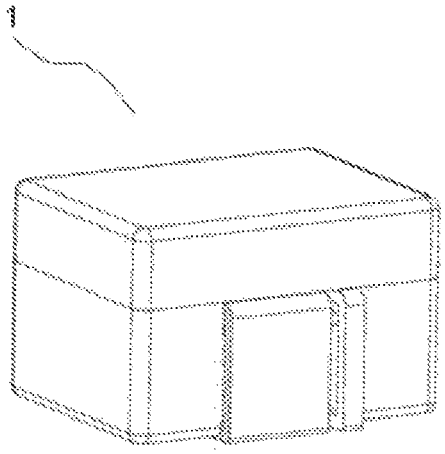
FIG. 1 is a perspective view of an inductor.
Figure 2:
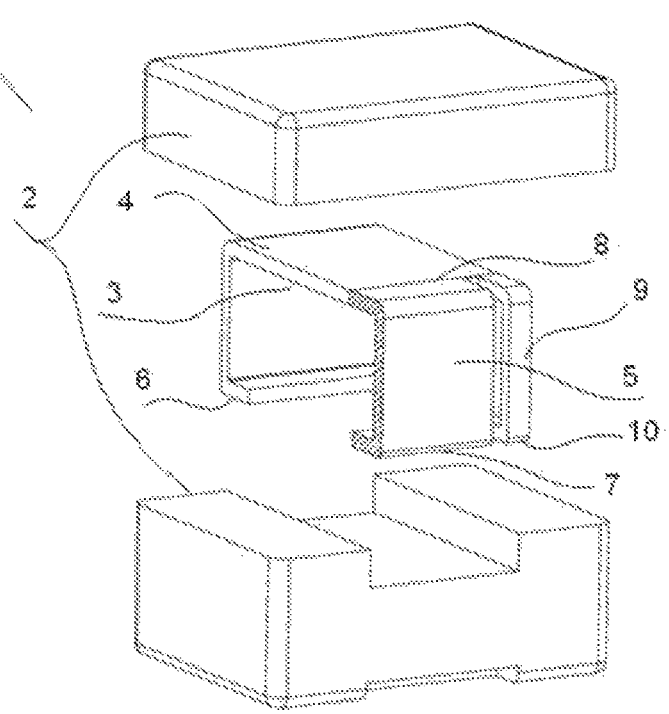
FIG. 2 is a exploded perspective view of the inductor of FIG. 1.
Figure 3:
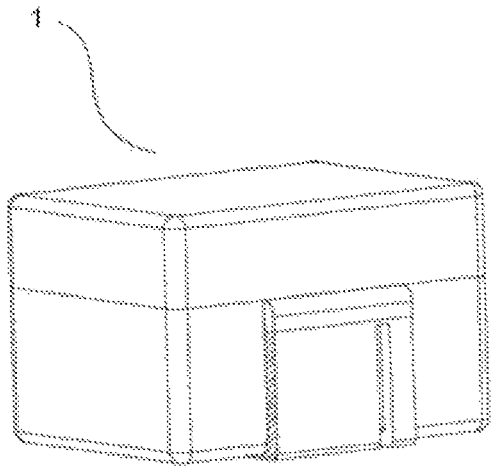
FIG. 3 is a perspective view of an inductor.
Figure 4:
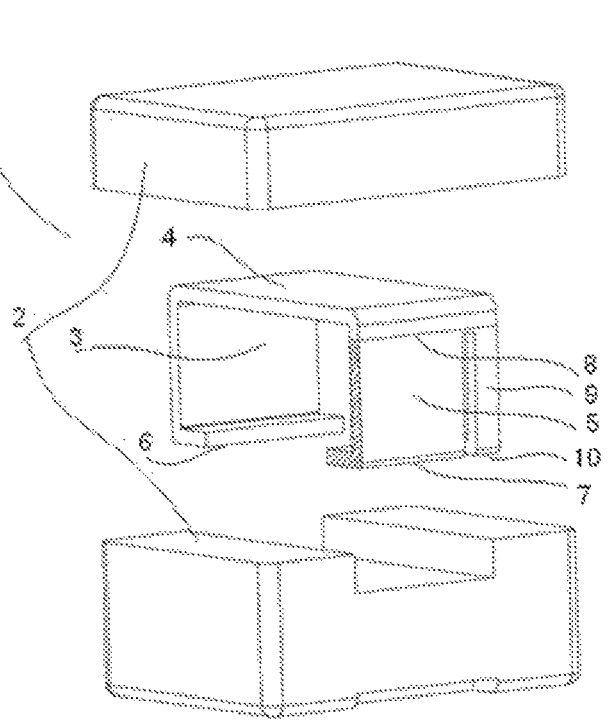
FIG. 4 is a exploded perspective view of the inductor of FIG. 3.
Figure 5:
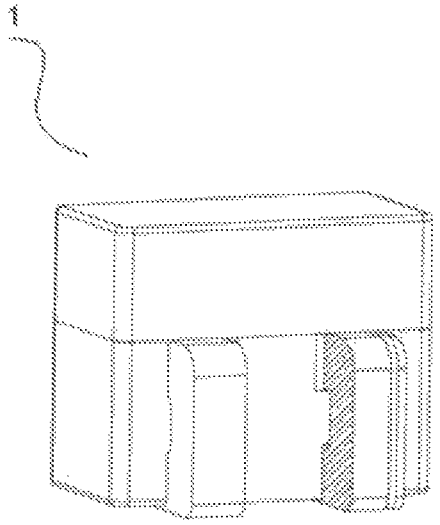
FIG. 5 is a perspective view of an inductor.
Figure 6:
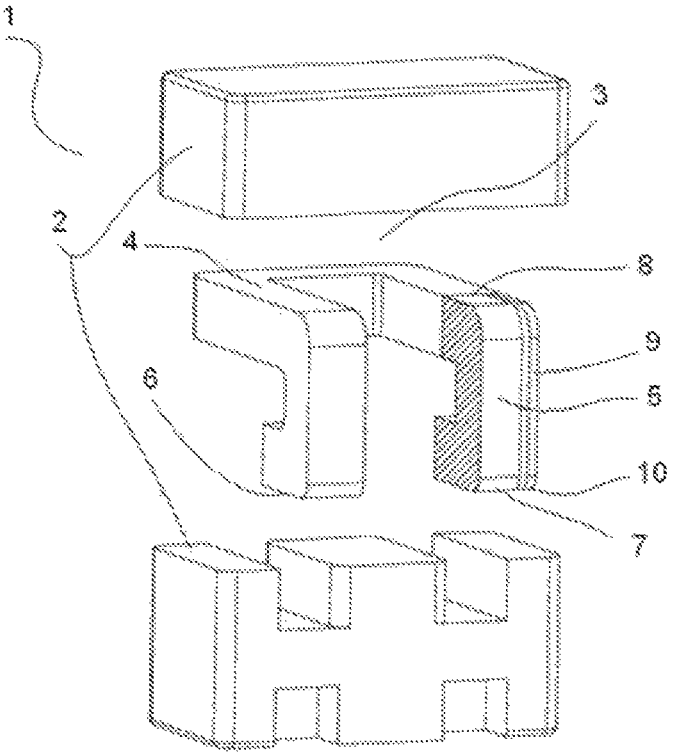
FIG. 6 is a exploded perspective view of the inductor of FIG. 5.
Figure 7:
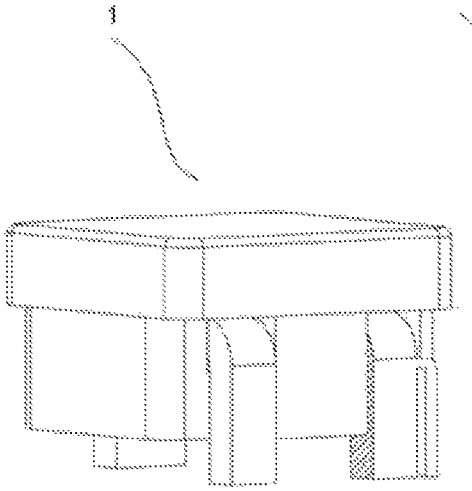
FIG. 7 is a perspective view of an inductor.
Figure 8:
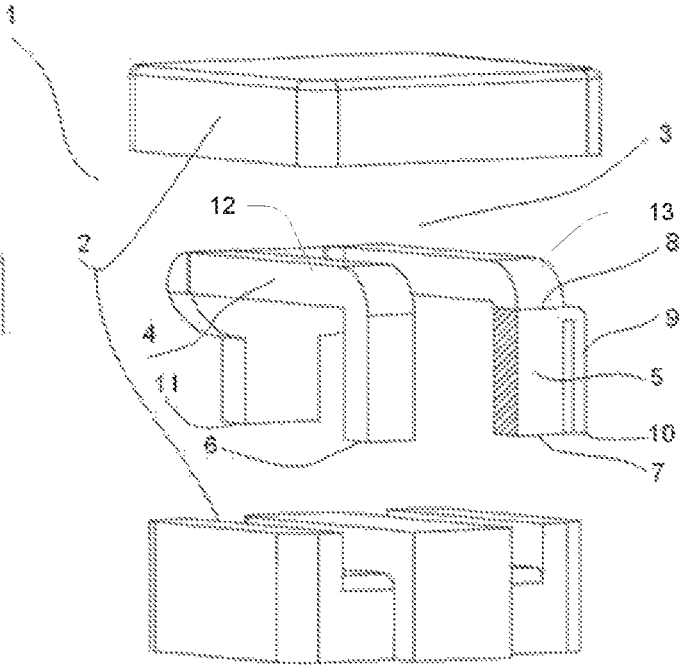
FIG. 8 is a exploded perspective view of the inductor of FIG. 7.

A power inductor 1 includes a core 2 and a winding 3. The winding 3 has at least two portions, one portion 4 made of pure copper, the other portion 5 made of low-TCR (temperature coefficient of resistance) alloy such as a manganese copper alloy (i.e., an alloy sold under the trademark Manganin®) or certain nickel-copper alloys (e.g., a high-Nickel-content alloy sold under the trademark Constantan®). One end of the pure copper portion 4 and the alloy portion 5 has terminal 6 and terminal 7 respectively, and the other ends are welded together or adhered together by conductive adhesives to form a combination with joint 8. Inductor current flows between terminals 6 and 7. A sensing lead 9 is bound to the combination as well, with one end of sensing lead 9 being a detecting terminal 10. The sensing lead 9 is of the same low-TCR material as the alloy portion 5. In the embodiments of FIGS. 8-10, a support lead 11 of the inductor is also shown.

In these embodiments, a precision low-TCR current sensor is formed between combination 8 and terminal 7.

Also in this embodiment, the copper portion 4 has three sub-portions which include (1) the support lead 11 as a first sub-portion, configured to support the inductor when mounted on a substrate, (2) a second sub-portion 12 extending between the terminal 6 and one (upper) end of the support lead 11, and (3) a third sub-portion 13 extending between the alloy portion 5 and a second upper end of the support lead 11. Also in this embodiment, the terminal 6 and the alloy portion 5 are located side-by-side at one end of the winding 4 (the near end in FIG. 8); the second and third sub-portions 12, 13 are parallel to each other and extend from the one end of the winding 4 to a second end of the winding (far end in FIG. 8); and the support lead 11 is located at the second end of the winding 4. The resistance of the current sensor can be adjusted by adjusting the cross-section area and/or length of alloy portion 5. The voltage drop between sensing terminal 10 and terminal 7 is proportional to the current flowing through the inductor from terminal 6 to the terminal 7.

Generally it is desirable that the alloy portion 5 have a TCR much lower than that of copper, e.g., by 1-2 orders of magnitude. Copper has a TCR on the order of $10^{-3}$, so the alloy portion 5 should have a TCR of $10^{-4}$ or less. For the examples of Manganin and Constantan alloys, a TCR on the order of $10^{-5}$ may be achieved.

In the illustrated examples, the alloy portion 5 is physically in parallel with but spaced apart from the sensing lead 9. The alloy portion has a first width and extends between the terminal 7 and the joint 8, and the sensing lead 9 has a second narrower width and extends from the sensing terminal 10 to the joint 8. In the illustrated embodiments the ratio of these widths is on the order of 5:1. Generally, the second narrower width is one-half or less the first width. More specifically, the second narrower width may be one-quarter or less the first width.

The inductor achieves a desired balance of resistivity and accuracy of current sensing. The pure copper portion 4 of the winding provides for overall low resistivity even in combination with the alloy portion 5, while the alloy portion 5 provides for more accurate current sensing than in pure copper inductors. The inductor can provide accurate current detection sensor while minimizing total resistance of the winding. Thus, for a limited size inductor, electrical performance can be optimized in a desirable way.

While various embodiments of the invention have been particularly shown and described, it will be understood by those skilled in the art that various changes in form and details may be made therein without departing from the scope of the invention as defined by the appended claims.

What is claimed is:

1. A power inductor, comprising:

a core; and a winding, the winding having two portions, one portion being a copper portion having a first conductive terminal and being made of pure copper, the other portion being an alloy portion having a second conductive terminal and being made of a low-temperature-coefficient-of-resistance alloy, wherein the alloy portion includes a sensing terminal separate from the first and second conductive terminals to enable the alloy portion to be used as a current sensor for sensing current flowing through the winding, the copper portion having three sub-portions being (1) a first sub-portion being a support terminal configured to support the inductor when mounted on a substrate, (2) a second sub-portion extending between the first conductive terminal and a first end of the support terminal, and (3) a third sub-portion extending between the alloy portion and a second end of the support terminal.

2. A power inductor according to claim 1, wherein the alloy portion includes a nickel-copper alloy or a manganese-copper alloy.

3. A power inductor according to claim 1, wherein a voltage drop between the sensing terminal and the second conductive terminal is proportional to the magnitude of current flowing between the first and second conductive terminals of the inductor.

4. A power inductor according to claim 1, wherein (1) the first conductive terminal and the alloy portion are located side-by-side at one end of the winding, (2) the second and third sub-portions are parallel to each other and extend from the one end of the winding to a second end of the winding, and (3) the support terminal is located at the second end of the winding.

5. A power inductor according to claim 1, wherein each of the copper portion and the alloy portion has two respective ends, first ends of the respective portions including the respective conductive terminals, and second ends of the respective portions being joined together.

6. A power inductor according to claim 5, wherein the second ends are joined by a weld seam.

7. A power inductor according to claim 5, wherein the second ends are joined by conductive adhesive.

8. A power inductor according to claim 1, wherein:

the alloy portion has a first width and extends between the second conductive terminal and a joint at which the alloy portion joins the copper portion; and the power inductor includes a sensing lead of the low-temperature-coefficient-of-resistance alloy, the sensing lead having a second narrower width and extending from the sensing terminal to the joint.

9. A power inductor according to claim 8, wherein the second narrower width is one-half or less the first width.

10. A power inductor according to claim 9, wherein the second narrower width is one-quarter or less the first width.

* * * * *